US005967307A

United States Patent [19]

Wang

[11] Patent Number: 5,967,307

[45] Date of Patent: Oct. 19, 1999

[54] COMBINATION OF A DECORATIVE MEMBER AND A CONTAINER

[76] Inventor: Ching-Chen Wang, No. 11, Hsinyi S. Rd., Anping Industrial Dist., Tainan, Taiwan

[21] Appl. No.: 09/215,780

[22] Filed: Dec. 18, 1998

[51] Int. Cl.[6] ..... B65D 85/72

[52] U.S. Cl. ..... 206/217; 206/457; 215/383; 446/74; 446/77

[58] Field of Search ..... 206/457, 575, 206/37, 38, 486, 541, 217, 216; 446/72, 73, 74, 75–77; 215/386, 383

[56] References Cited

U.S. PATENT DOCUMENTS

| | | | |
|---|---|---|---|
| 5,029,700 | 7/1991 | Chen | 206/217 |
| 5,050,757 | 9/1991 | Hidding et al. | 215/383 |
| 5,156,283 | 10/1992 | Sampson | 215/383 |
| 5,201,431 | 4/1993 | Berger et al. | 215/383 |
| 5,419,436 | 5/1995 | Powell | 206/217 |
| 5,823,329 | 10/1998 | Roberts | 206/216 |

*Primary Examiner*—B. Dayoan
*Assistant Examiner*—Luan K. Bui
*Attorney, Agent, or Firm*—Dellett and Walters

[57] ABSTRACT

A cup has a first recess defined in the outside thereof with two protrusions extending from the bottom of the first recess, a board received in the first recess and having two engaging members to securely engage the two protrusions. The board has a serrated groove defined therethrough so that a bolt movably extends through the groove and connects to a decorative member on the outside of the cup. The decorative member will move downward along the serrated groove and can also rotate relative to the cup when the cup is inclined.

5 Claims, 4 Drawing Sheets

COMBINATION OF A DECORATIVE MEMBER AND A CONTAINER

FIELD OF THE INVENTION

The present invention relates to a container having a board connected to the outside thereof and a decorative member attached to the board which is movable within a groove defined through the board.

BACKGROUND OF THE INVENTION

Generally, containers such as teapots, cups or the like are designed to attract users' attention or interest by their special configuration, shape or colors. Cups designed for kids have beautiful colors or lovely marks so that kids are willing to use the cups and commercial benefits are gained. That is to say, the manufacturers or the designers of cups for kids exert a lot of effort to produce something that grasps children's interest. It is difficult to make a significant breakthrough in designing cups to have brand new shapes or colors that kids can enjoy.

The present invention intends to provide a movable decorative member which can be rotated and/or movable on the outside of the cup.

The present invention has arisen to mitigate and/or obviate the disadvantage of the conventional container such as cups.

SUMMARY OF THE INVENTION

In accordance with one aspect of the present invention, there is provided a combination of a decorative member and a container, the container having a first recess defined in the outside thereof and two protrusions extending from the bottom of the first recess so as to engage two engaging members of the board which is attached to the outside of the cup and has a serrated groove defined therethrough. A connecting member movably extends through the groove and a decorative member is fixedly connected to the connecting member so that the decorative member is movably and rotatably attached to the outside of the board.

The main object of the present invention is to provide an interesting decorative member attached to a cup wherein the decorative member moves along a serrated groove of a board attached to the cup when the cup is upside down.

Further features of the present invention will become apparent after a careful reading of the detailed description with appropriate reference to the accompanying drawings.

DETAILED DESCRIPTION OF THE PREFERRED EMBODIMENT

Figure 1:
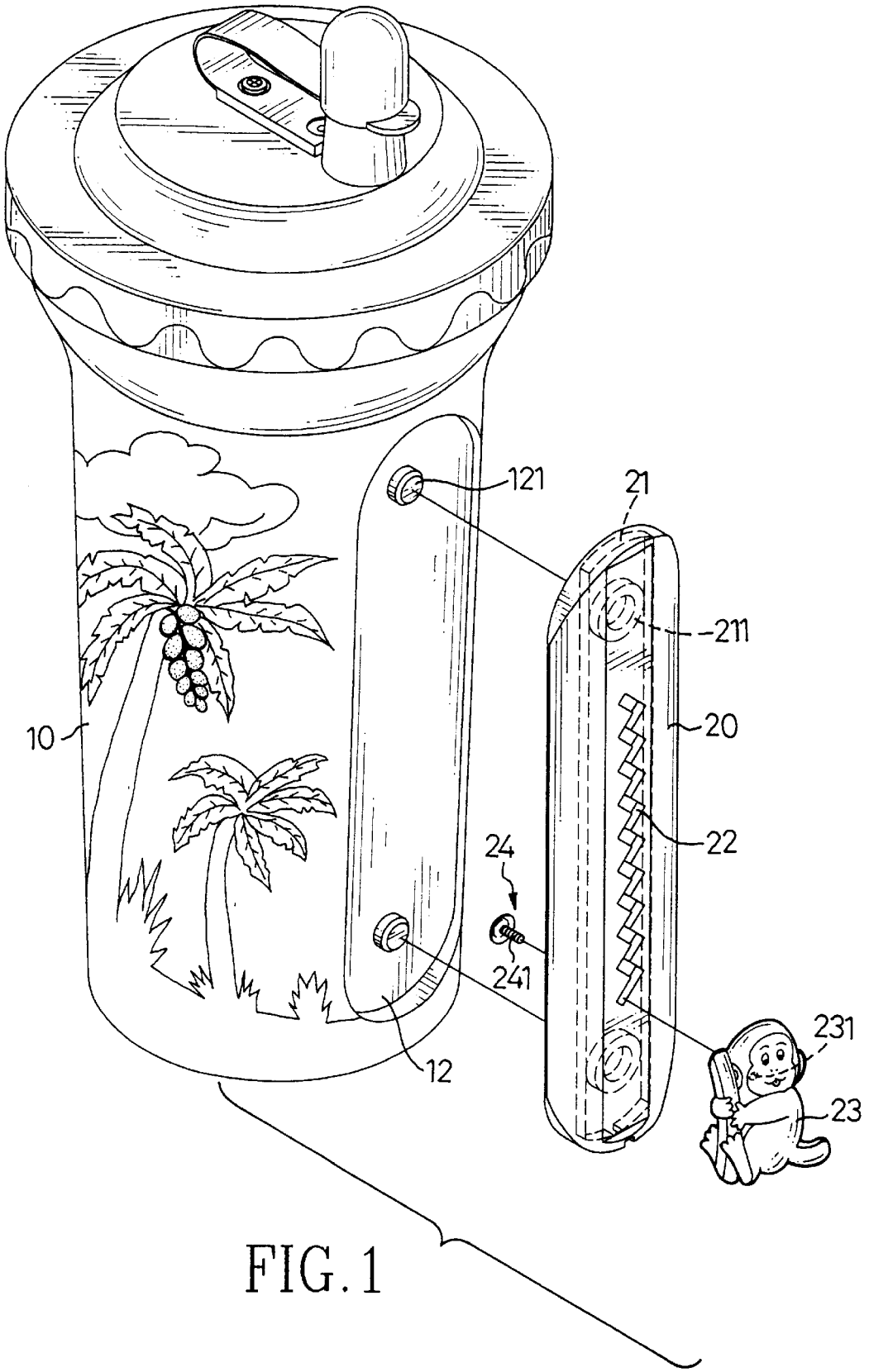
FIG. 1 is an exploded view of the cup, the board and the decorative member in accordance with the present invention.
Figure 2:
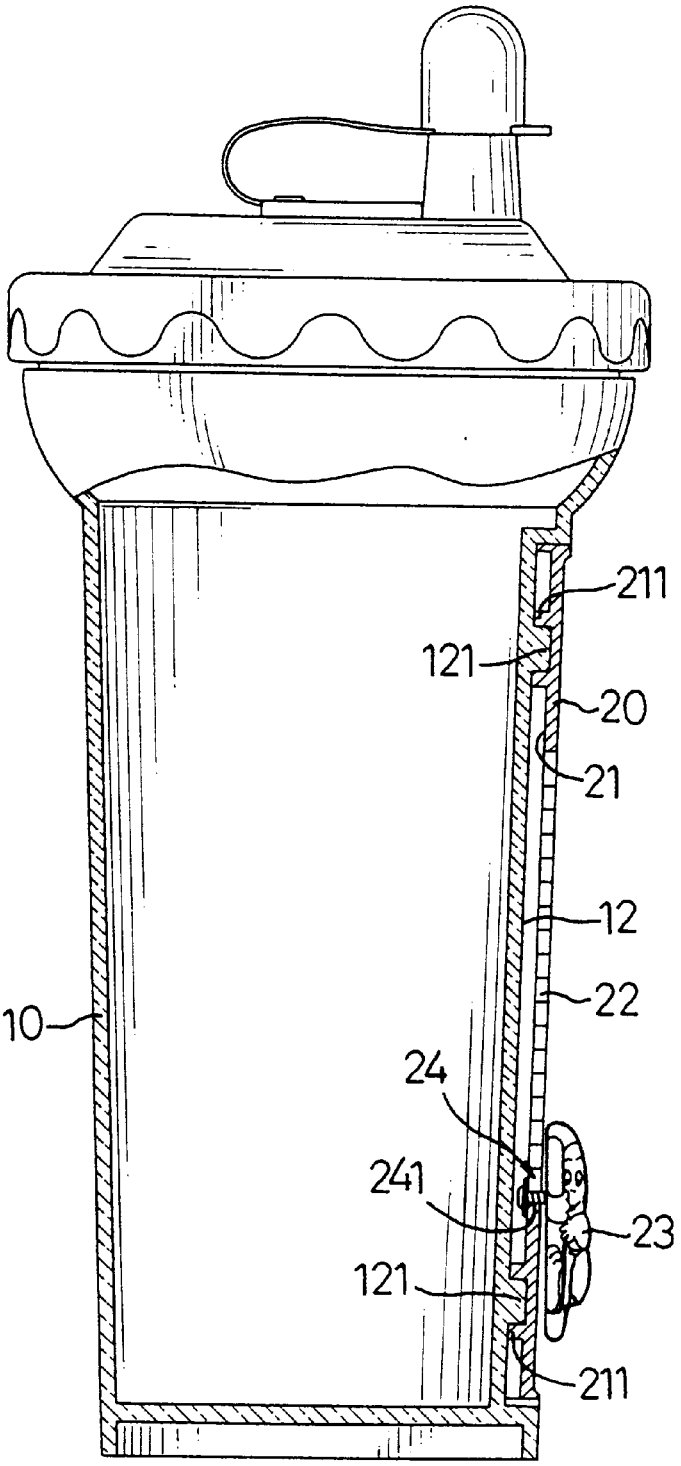
FIG. 2 is a side elevational view, partly in section, of the combination of the cup, the board and the decorative member in accordance with the present invention.

Referring to FIGS. 1 and 2, the container such as a cup (10) has a first recess (12) defined in the outside thereof and two protrusions (121) extending from the bottom of the first recess (12). A board (20) has a second recess (21) defined in the first side thereof and two engaging members such as two ring-shaped members (211) extend from the bottom of the second recess (21) so that the two protrusions (121) are securely engaged with the two ring-shaped members (211) to receive the board (20) in the first recess (12).

A connecting member such as a bolt (24) extends through the serrated groove (22) from the first side of the board (20) and a decorative member (23) is fixedly connected to the bolt (24) by threadedly extending the shank (241) of the bolt (24) into the threaded hole (231) in the decorative member (23) so that the decorative member (24) is movably and rotatably attached to the first side of the board (20).

Figure 3:
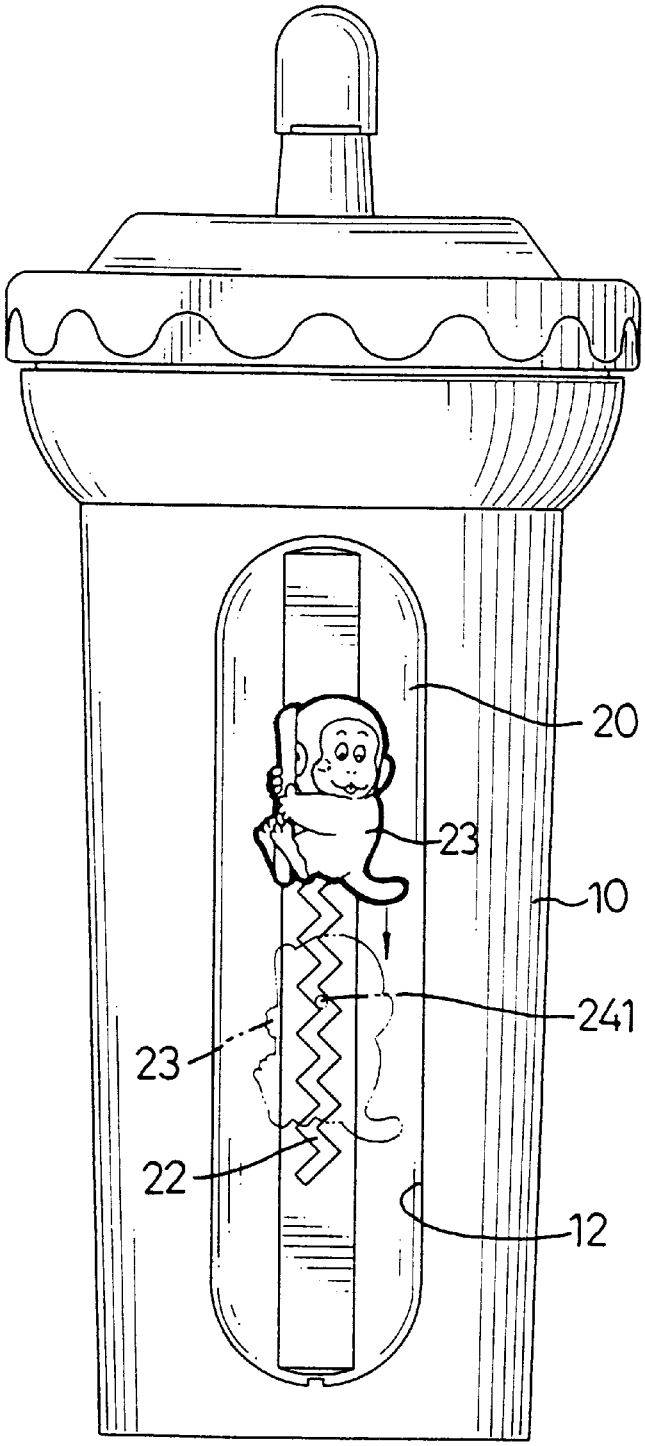
FIG. 3 is an illustrative view to show the movement of the decorative member on the cup.
Figure 4:
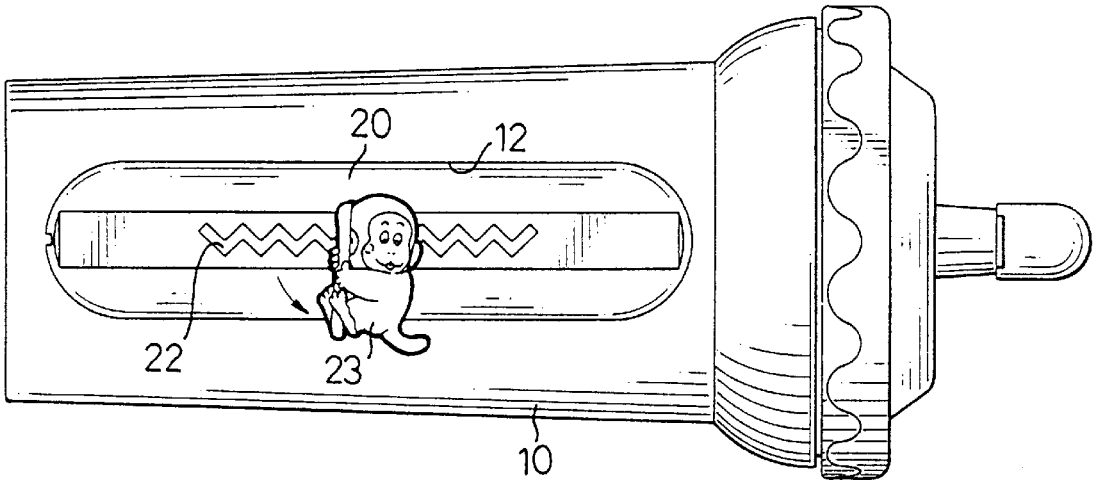
FIG. 4 is illustrative view to show that the decorative member rotates relative to the cup.

With reference to FIG. 3, the decorative member (23) can be manually moved to the top of the board (20) or by turning the cup (10) upside down, and the decorative member (23) then moves downward along the serrated groove (22) by gravity. FIG. 4 shows that when the cup (10) is inclined, the decorative member (23) rotates relative to the board (20).

The shape of the groove (22) can be varied according to the path that the decorative member (23) is expected to move. The board (20) can also be connected to the cup (10) at an inclined angle to let the decorative member (23) move along an inclined path.

It is to be understood that the above description and drawings are only used for illustrating some embodiments of the present invention, and are not intended to limit the scope thereof. Any variation and derivation from the above description and drawings should be included in the scope of the present invention.

What is claimed is:

1. A combination of a decorative member (23) and a container (10), said container (10) having a first recess (12) defined in the outside thereof and two protrusions (121) extending from the said first recess (12);

a board (20) having a first side and a second side, said second side attached to the first recess said container (10) and having a groove (22) defined therethrough, and a connecting member (24) movably extending through said groove (22) and said decorative member (23) fixedly connected to said connecting member (24) so that said decorative member (24) is movably and rotatably attached to the first side of said board (20).

2. The combination as claimed in claim 1, wherein said board (20) has a second recess (21) defined in the second side thereof and two engaging members (211) extend from said second recess (21) so as to engage with said two protrusions (121) to receive said board (20) in said first recess (12).

3. The combination as claimed in claim 2, wherein each of said engaging members (211) are a ring-shaped member.

4. The combination as claimed in claim 1, wherein said groove (22) is a serrated groove.

5. The combination as claimed in claim 1, wherein said connecting member (24) is a bolt.

* * * * *